United States Patent [19]

Saintsbury et al.

[11] Patent Number: 4,549,402

[45] Date of Patent: Oct. 29, 1985

[54] COMBUSTOR FOR A GAS TURBINE ENGINE

[75] Inventors: John A. Saintsbury, Hemmingford; Parthasarathy Sampath, Mississauga; Maurice Weinberg, Willowdale, all of Canada

[73] Assignee: Pratt & Whitney Aircraft of Canada Limited, Longueuil, Canada

[21] Appl. No.: 650,992

[22] Filed: Sep. 17, 1984

Related U.S. Application Data

[63] Continuation of Ser. No. 382,416, May 26, 1982, abandoned.

[51] Int. Cl.[4] ..... F02C 7/22

[52] U.S. Cl. ..... 60/738; 60/759; 60/760

[58] Field of Search ..... 60/732, 737, 738, 759, 60/760, 740

[56] References Cited

U.S. PATENT DOCUMENTS

| | | | |
|---|---|---|---|
| 2,780,061 | 2/1957 | Clarke et al. | 60/740 |
| 2,956,404 | 10/1960 | Kassner et al. | 60/738 |
| 2,974,487 | 3/1961 | Stokes et al. | 60/738 |
| 3,633,361 | 1/1972 | Vanves | 60/738 |
| 3,691,766 | 9/1972 | Champion | 60/760 |
| 3,844,116 | 9/1974 | Matto | 60/760 |

*Primary Examiner*—Louis J. Casaregola
*Assistant Examiner*—Timothy S. Thorpe
*Attorney, Agent, or Firm*—Fleit, Jacobson, Cohn & Price

[57] ABSTRACT

A combustor for a gas turbine is provided, the combustor including a reverse flow type combustion chamber defined by an inner cylindrical wall and an outer wall concentric with the inner wall and connected at one end by an annular dome. The outer wall has three successive sections with the first section being cylindrical and of a predetermined diameter, the second outer wall section being of frusto-conical shape, and the third wall section being of cylindrical shape but of reduced diameter compared to the first section. Injectors are provided in the angled wall of the second outer wall section, and openings are provided annular with the injectors to allow compressor delivered air to enter directly into the combustion chamber surrounding the injector, the injector being directed towards the primary zone.

4 Claims, 4 Drawing Figures

COMBUSTOR FOR A GAS TURBINE ENGINE

This application is a continuation of application Ser. No. 382,416, filed May 26, 1982, now abandoned.

BACKGROUND OF THE INVENTION

1. Field of the Invention

The present invention relates to combustors for gas turbine engines, and more particularly, to an annular reverse flow type of combustor or combustion chamber, with a fuel vaporizer arrangement.

2. Description of the Prior Art

Presently, annular reverse flow combustors have their fuel injectors situated at the dome of the combustor, with compressed air being bled into the combustor from an annular duct surrounding the combustor, particularly into the primary zone surrounding the fuel injector or nozzle in a manner to create fuel/air mixing therein. In some cases, vaporizers have been provided in order to improve the burning efficiency of the mixture so formed. A vaporizer allows the fuel to vaporize as it advances in a delivery tube which is within the combustion chamber and thus subject to very high temperatures, thus vaporizing the fuel before it is combusted in the primary zone.

An example of the above is illustrated in U.S. Pat. No. 2,956,404, Kassner et al, issued Oct. 18, 1960, and German Offenlegungsschrift No. 2,329,367, published Dec. 20, 1973. Other examples of reverse flow combustors, but without the vaporizer, are U.S. Pat. Nos. 3,919,840, Markowski, issued Nov. 18, 1975, and 4,195,476, Wood, issued Apr. 1, 1980.

SUMMARY OF THE INVENTION

It is an aim of the present invention to provide an improved reverse flow combustor, particularly adapted for vaporizers or air-blast fuel delivery systems which normally are suited for axial combustors where compressor delivered air can be more readily utilized.

It is also an aim of the present invention to provide an improved cooling arrangement of the secondary zone of the combustor.

A construction in accordance with the present invention comprises a reverse flow annular combustor having an inner cylindrical wall, an outer wall concentric with the inner wall and connected at one end by an annular dome, the outer wall having a first cylindrical wall portion adjacent the dome and having a predetermined diameter, and a second outer wall portion, adjacent the first wall portion and remote from the dome, the second wall portion having a frusto-conical shape and terminating in a third wall portion of cylindrical shape and of reduced diameter compared to the diameter of the first wall portion, wherein the dome and first and second outer wall portions define generally the primary combustion zone and the third outer wall portion defines the secondary zone, and fuel injector means disposed circumferentially of said second wall portion, directed towards the dome and associated with compressed air intake means, such that compressor delivered air is directly injected into the primary zone by virtue of the intake means being provided on the second wall of frusto-conical shape, thus at an angle to the direction of said compressor delivered air.

The novel outer wall arrangement also provides for larger primary zone for improved combustion. It also results in reduced surface area and intermediate zone depth, thereby reducing cooling air requirements.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2, 3, 4:
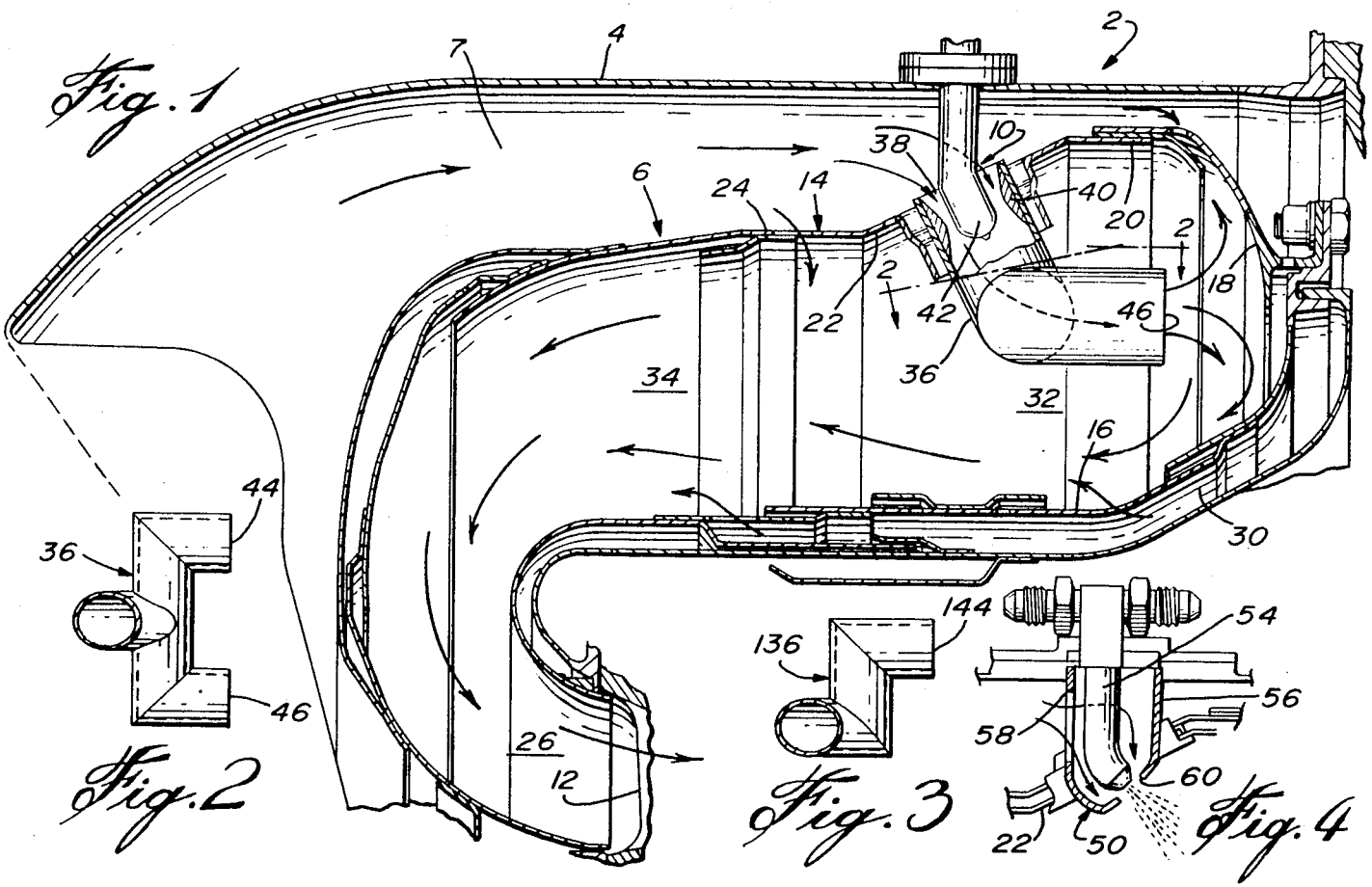
FIG. 1 is a fragmentary, axial cross-section of a portion of a gas turbine engine and particularly the combustor section.
FIG. 2 is a horizontal cross-section taken along line 2—2 of FIG. 1.
FIG. 3 is a view similar to FIG. 2 but showing a different embodiment thereof.
FIG. 4 is a fragmentary cross-section of another embodiment of a detail of the combustor as shown in FIG. 1.

Referring now to the drawings, a gas turbine engine 2 includes an outer casing 4 of generally cylindrical form, containing an annular reverse flow combustor 6 surrounded by an annular duct 7. The annular duct 7 is, of course, downstream of a compressor (not shown). A fuel injector 10 is provided on the outer wall 14 of the combustor 6. The shape of the combustor is such that the flow is reversed and leads to a first turbine wheel represented by the blades 12. The combustor 6 includes, as mentioned previously, an outer wall 14, which is an annular wall, and a concentric inner wall 16, which is of generally cylindrical shape. A dome 18 extends at one end between the inner wall 16 and the outer wall 14.

The outer wall 14 includes three separate outer wall sections, namely, a first portion 20, which is of cylindrical configuration, and a second wall section 22, which is of frusto-conical shape, with the third wall section 24 extending from the edge of smaller diameter of the second section 22. A plurality of fuel injectors 10 are provided, spaced apart peripherally about the outer wall 14 but in the confines of the second outer wall portion 22. Thus, the frusto-conical wall 22 presents an angled surface to the flow in duct 7, and the injector 10 is mounted on the angled surface of the outer wall 14, namely, on portion 22. The first outer wall portion 20 and the second outer wall portion 22 represent the primary combustion zone 32, while the third outer wall portion 24 represents the secondary combustion zone 34. The flow path from the secondary combustion zone is directed by passage 26 to the turbines 12.

The injector 10 includes a vaporizer tube 36 mounted concentrically with the end of the nozzle 42 of the injector 10 and includes an annular opening 38 allowing compressor delivered air to enter the tube 36 about the nozzle 42 and mix with the fuel being injected through the nozzle 42. The vaporizer tube, as is well known, is within the confines of the primary zone, but in the present case, is directed towards the dome 18. The vaporizer tube 36 can be in the form shown in FIG. 2 or could be an elbowed tube 136 as shown in FIG. 3. In the case of the shape shown in FIG. 2, there are two tube ends 44 and 46 on vaporized fuel to enter the primary zone. Thus, since the wall portion 22 is at an angle, compressor delivered air is easily deflected into the tube 36 about the nozzle 42, and since the tube 36 is within the primary combustion zone 32, it transfers considerable heat to the air and fuel which has been atomized as a result of the compressor delivered air passing the venturi 40, and because of the heat transfer, the fuel is vaporized before it leaves the tube ends 44 and 46.

Keeping the same configuration of combustor, an air blast assembly 50 as shown in FIG. 4 can be substituted for the vaporizer assembly 36, and of course, the air blast assembly 50 would be mounted in the same wall portion 22 as is the injector 10. The air blast assembly 50 includes a nozzle 54 and a tube 56 having openings 58 allowing the compressor delivered air to enter the annular space formed by the tube 56 around the nozzle 54 and exit with the fuel through opening 60.

In the present case, the combustor is provided with a cooling-air annular passage 30 in the form of a duct concentric and co-extensive with the inner wall 16. Compressor delivered air, which does not enter into the combustor, passes around the dome 18 into the ducts 30 for cooling the inner wall of the combustor. This same compressor delivered air cools the outer wall of the combustor as well.

We claim:

1. A combustor in a gas turbine engine of the type including a reverse flow annular combustor, the combustor having an inner cylindrical wall, an outer wall concentric with the inner wall about a combustor axis, and an annular dome connecting the inner wall and outer wall, the outer wall having a first cylindrical wall portion adjacent the dome and having a predetermined diameter, a second outer wall portion adjacent the first wall portion and remote from the dome, the second wall portion terminating in a third wall portion of cylindrical shape and of reduced diameter compared to the diameter of the first wall portion such that the second outer wall portion is frusto-conical; the dome, first and second outer wall portions define the primary combustion zone, and the third outer wall portion defines the secondary zone, the engine including a casing surrounding the reverse flow combustor and defining an annular air passage for compressor delivered air with the outer wall of the combustor; fuel injector means disposed on the second wall portion, and directed towards the dome, compressor delivered air intake means adjacent said fuel injector means, the cross-sectional area of the annular air passage at the first wall portion being less than the cross-sectional area of the annular passage at said third wall portion thereby creating a pressure head such that compressor delivered air is directly injected into the primary zone with the fuel by virtue of intake means being provided adjacent the fuel injector means.

2. A combustor as defined in claim 1, wherein the angle of the second outer wall portion is at an obtuse angle to the direction of compressor delivered air flow in an annular duct surrounding the combustor, when the direction of the air is parallel to the axis of the combustor.

3. A combustor as defined in claim 1, wherein an air blast assembly is used as injector means with the air blast assembly, including a pipe extending within the annular compressor delivered air duct surrounding the combustor and being mounted on the second outer wall portion, the assembly including a fuel nozzle located in an opening within the confines of the combustion chamber such that compressor delivered air atomizes the fuel leaving the nozzle and entering the combustion chamber through said opening.

4. A combustor as defined in claim 1, wherein the dome, first wall portion and second wall portion define a volume greater than the volume defined by the third wall portion.

* * * * *